United States Patent [19]

Nakatsubo et al.

[11] 4,325,625

[45] Apr. 20, 1982

[54] ELECTROPHOTOGRAPHING METHOD

[75] Inventors: Toshio Nakatsubo; Kaoru Ohyoshi; Masaji Nishikawa, all of Hachioji; Eiichi Sato, Tama; Norio Mizukami; Akira Shimizu, both of Tokyo; Kazuhisa Yanagisawa, Mitaka; Kenichi Oinoue, Tokyo; Naotsune Tsuda; Yoshiro Suzuki, both of Hachioji, all of Japan

[73] Assignee: Olympus Optical Company Limited, Tokyo, Japan

[21] Appl. No.: 75,834

[22] Filed: Sep. 13, 1979

Related U.S. Application Data

[63] Continuation of Ser. No. 883,258, Mar. 3, 1978, abandoned.

[30] Foreign Application Priority Data

Mar. 7, 1977 [JP] Japan ..... 52/23744

[51] Int. Cl.[3] ..... G03G 15/00

[52] U.S. Cl. ..... 355/3 SC; 355/77; 430/53

[58] Field of Search ..... 355/3 SC, 3 CH, 3 R, 355/77; 430/31, 53, 54

[56] References Cited

U.S. PATENT DOCUMENTS

| | | | |
|---|---|---|---|
| 3,281,241 | 10/1966 | Mihajlov | 96/1 R |
| 3,964,827 | 6/1976 | Tanaka et al. | 355/3 SC |
| 4,021,109 | 5/1977 | Tanaka et al. | 355/3 SC |
| 4,046,466 | 9/1977 | Ando et al. | 355/3 SC |
| 4,099,863 | 7/1978 | Nakatsubo | 355/3 SC |

*Primary Examiner*—Richard L. Moses
*Attorney, Agent, or Firm*—Fleit & Jacobson

[57] ABSTRACT

An electrophotographing method for use in a copying apparatus employing a sensitizing screen having a great number of fine apertures, made in a drum shape, and a transferring means having a conductive base plate and a charge storage layer formed on the base plate. The transferring means is constructed in the form of a drum. During the process of obtaining a great number of copies from a primary electrostatic latent image which has been stored on the sensitizing means, a secondary electrostatic latent image is formed and regenerated on the transferring means from the stored primary latent image.

7 Claims, 10 Drawing Figures

ELECTROPHOTOGRAPHING METHOD

This is a continuation of application Ser. No. 883,258, filed Mar. 3, 1978, now abandoned.

BACKGROUND OF THE INVENTION

1. Field of the Invention

The present invention relates to an electrophotographing method and an apparatus for obtaining a great number of copied images by only one exposure and scanning of a document.

2. Description of the Prior Art

The electrophotographing technique in which a primary electrostatic latent image corresponding to an image of a document is formed on a sensitizing member, and a number of copied images are obtained based on the primary latent image by using storage capability of the sensitizing member, is described and is well known, for example, U.S. Pat. No. 3,713,734 and Japanese Laid Open Patent Application No. 68,531/75. In the technique shown in these publications, provision is made for a sensitizing screen having a number of fine apertures such as mesh. A primary latent image corresponding to an image of a document is formed on the sensitizing screen and electric fields formed at the fine apertures by the primary latent image, form a secondary latent image on another charge storage layer, by controlling the ions flowing through the apertures. The secondary latent image thus obtained is developed and fixed to obtain an ultimate copied image. In the electrophotographing technique of this kind, a number of secondary latent images can be formed and thus a plurality of copied images are obtained as long as the primary latent image is efficiently stored on the sensitizing screen.

SUMMARY OF THE INVENTION

An object of the present invention is to provide an electrophotographing method in which multiple copying characteristics in the above mentioned electrophotographing technique are remarkably improved and a number of copies can advantageously be obtained with only one exposure and scanning of a document.

Another object of the present invention is to provide an electrophotographing apparatus for obtaining a number of copies from only one primary electrostatic latent image formed on a sensitizing screen with the use of the above method according to the present invention.

An electrophotographing method according to the present invention employs an apparatus having a sensitizing screen with a great number of fine apertures and a transferring member having a charge storage layer formed on a conductive base plate. A primary electrostatic latent image corresponding to an image of a document is formed on the screen and then a secondary electrostatic latent image is formed on the transferring member based on the primary latent image so to obtain a copy from the secondary latent image by developing and transferring. In the process for obtaining a great number of copies based on the primary latent image once formed on the sensitizing screen, the secondary latent image is repeatedly formed on the transferring member, based on the primary latent image which has been stored on the sensitizing screen.

The number of copies obtained by repeatedly developing and transferring from the secondary latent image which is once formed on the charge storage layer of the transferring member, is generally limited to a few hundred. If more than the limited number of copies must be obtained, it is necessary to repeat the full process of copying or to find other means for satisfying the above necessity.

In the method according to the present invention, employing the storage characteristics of the primary electrostatic latent image formed on the sensitizing screen and of the secondary electrostatic latent image formed on the charge storage layer, enables a few thousand copies to be obtained.

In the method according to the present invention, after a predetermined number of copies are obtained from a secondary latent image, the transferring member is cleaned and a new secondary latent image is again formed on the cleaned transferring member based on the primary latent image formed on the sensitizing screen. Alternatively, the secondary latent image formed on the transferring member has density which is decreased as copying proceeds so that the decreased amount of the density is supplemented from the stored primary latent image and thus a few thousand copies can be obtained from only one primary latent image formed on the sensitizing screen.

The electrophotographing apparatus according to the present invention comprises a sensitizing screen having a number of fine apertures, means for forming a primary electrostatic latent image corresponding to an image of a document on the sensitizing screen, means for erasing the primary latent image, a transferring member arranged opposite to the sensitizing screen, means for forming a secondary electrostatic latent image corresponding to the primary latent image on the transferring member, means for controlling formation of the secondary latent image, means for developing and forming a toner image by visualization of the secondary latent image, and means for transferring the toner image to a recording member. In the apparatus according to the present invention, during the process for obtaining a number of copies based on the primary latent image corresponding to the image of the document once formed on the sensitizing screen, the secondary latent image is formed on the transferring member based on the primary latent image which is stored on the sensitizing screen without erasing by the erasing means. By controlling the formation of the secondary latent image, the thus formed image is repeatedly developed and transferred to obtain a plurality of copies.

DESCRIPTION OF THE PREFERRED EMBODIMENTS

Referring to FIG. 1, a step for forming a secondary latent image on a transferring member is shown.

Figure 1A:
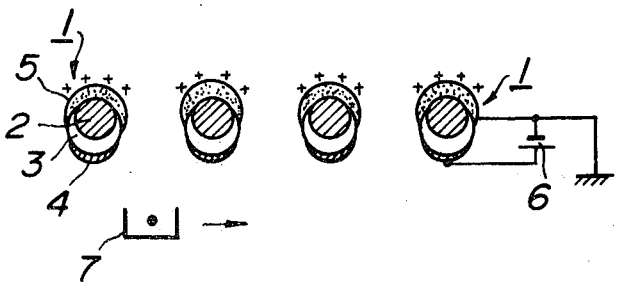
FIGS. 1*a* and 1*b* are diagrammatic views showing one embodiment of steps for forming a primary latent image according to the present invention.
Figure 1B:
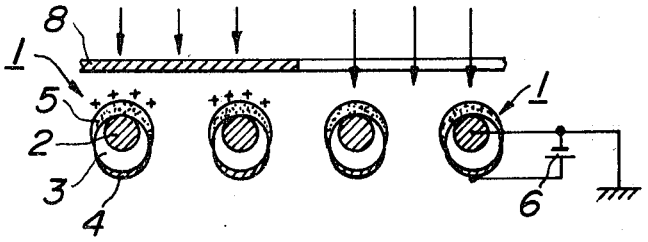

FIG. 1 is a sectional view showing one embodiment of the steps of forming a primary electrostatic latent image corresponding to an image of a document on a sensitizing screen. FIG. 1*a* shows the step of uniformly charging the sensitizing screen and FIG. 1*b* shows a step of illuminating the light image on the sensitizing screen. In the present embodiment, the sensitizing screen 1 comprises a conductive screen mesh 2 having a laminated layer of an insulating layer 3 and a conductive layer 4 at one surface and a sensitizing layer 5 at its other surface resulting in formation of a four layer structure. The conductive screen mesh 2 is formed of a screen having #100–300 mesh by conductively treating the surface of metal fiber such as stainless steel, nickel or the like or chemical fiber such as vinyl fiber, tetoron (trademark) fiber or the like, a screen constructed of a metal sheet having mesh apertures formed by photoetching treatment and a screen formed by electrofoaming the metal sheet. The insulating layer 3 is formed by spraying or depositing organic resin and inorganic resin (for example epoxy resin, acrylic resin, polystyrene, polyurethane, polyethylene, silicone oil, nylon, glass, selenium, etc.) having excellent insulating nature and capable of withstanding a high voltage characteristic. The conductive layer 4 is formed by depositing Al, Ag and other metal having a relatively low melting point or by spraying conductive powder. The sensitizing layer 5 is formed by an organic photoconductive material such as Se, CdS, ZnO, PbO, etc. or an inorganic photoconductive material such as polyvinyl carbazole or a composite material thereof. In this embodiment, selenium is used as a sensitizing layer.

As shown in FIG. 1*a* the sensitizing screen 1 is uniformly charged. A bias supply source 6 is connected between the conductive screen mesh 2 and the conductive layer 4 and a bias voltage of 250 v to 300 v is applied therebetween, while a corona charger (generator) 7 uniformly charges the sensitizing screen 1 from the side of the conductive layer 4 so that charges at the same voltage as that of the bias voltage are stored on the sensitizing layer 5.

As shown in FIG. 1*b*, the charged sensitizing screen 1 is illuminated by a light image so that a primary electrostatic latent image is formed on the sensitizing screen 1. That is, a document 8 is arranged over the sensitizing screen 1 at the side of the sensitizing layer 5 and the document 8 is illuminated by any illuminating means (not shown) so that a light image of the document 8 is illuminated on the sensitizing screen 1. Thus, a charge pattern (primary latent image) corresponding to the light image is formed on the sensitizing layer 5 since the sensitizing layer 5 has low resistance portions which correspond to the portions illuminated by a light part of the light image.

Figure 2:
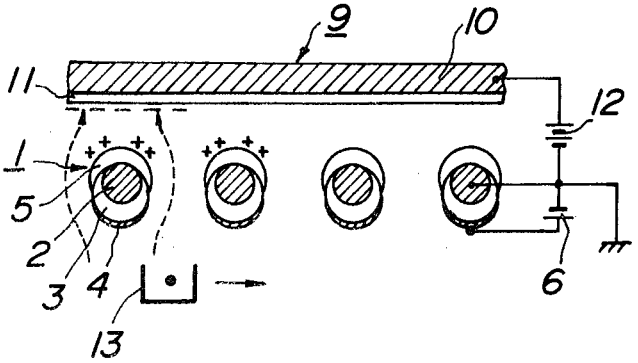
FIG. 2 is a diagrammatic view showing the step of forming a secondary latent image from the primary latent image shown in FIGS. 1*a* and 1*b;*

FIG. 2 is a sectional view showing one embodiment of a step of forming a secondary electrostatic latent image on the transferring member based on the thus formed primary latent image. As shown in FIG. 2, a transferring member 9 is arranged opposite to the sensitizing screen 1 having the primary latent image. The transferring member 9 comprises a conductive base plate 10 and a charge storage 11 laminated on the conductive base plate. The conductive base plate 10 may be constructed by conductively treating the surface of an insulating base plate. The charge storage layer 11 is constructed in the form of a single layer or a composite layer by using one or a mixture thereof having higher insulating material such as: glass film, polyurethane, acrylate resin, epoxy resin, polyester resin, polystyrene resin, vinyl chloride resin, nylon resin, polyimide silicone resin, fluorine plastics, allyl diglycol carbonate resin. The charge storage layer 11 is arranged opposite to the sensitizing layer 5 and a power supply source 12 for biasing the screen is connected between the conductive screen mesh 2 of the screen 1 and the conductive base plate 10 of the transferring member 9. A voltage of for example, 4 kv is applied between the conductive screen mesh 2 and the conductive base plate 10, while a corona generator 13 which is arranged at the side of the conductive layer 4 of the screen 1, projects corona ions having opposite polarity; a negative polarity, to that of charges of the primary latent image, for transferring member 9 through the sensitizing screen 1. The bias voltage of about 100 v is applied between the screen mesh 2 and the conductive layer 4, so that at the apertures of the screen 1, the bias voltage generates an electric field which prevents the corona ions of negative polarity projected by the corona generator 13, from passing through the apertures of the screen 1 and an electric field which facilitates corona ions from passing through the apertures based on the primary latent image formed on the sensitizing layer 5. A secondary electrostatic latent image is formed consisting of negative charges corresponding to the primary latent image is on the charge storage layer 11 of the transferring member 9. The polarity of the secondary latent image is preferably determined by the nature of material of the sensitizing layer 5. This constitutes the sensitizing screen 1 and determines whether the sensitizing layer is apt to store positive charge or negative charge.

Figure 3A:
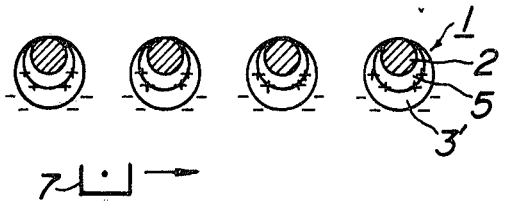
FIGS. 3*a* and 3*b* are diagrammatic views showing another embodiment of steps of forming a primary latent image according to the present invention.
Figure 3B:
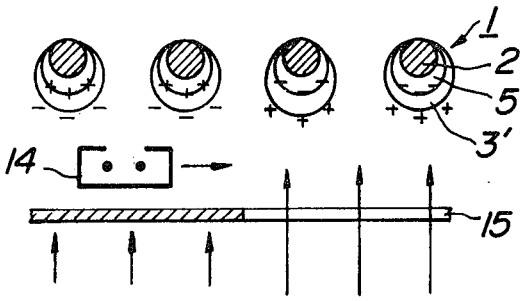
Figure 4:
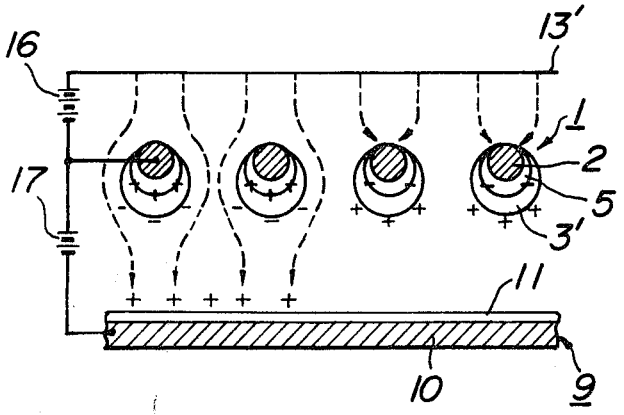
FIG. 4 is a diagrammatic view showing the step of forming a secondary latent image from the primary latent image shown in FIGS. 3*a* and 3*b;*

In the above steps for forming the secondary electrostatic latent image, a four layer structure is used as the sensitizing screen 1, but the secondary latent image may also be formed on the transferring member 9 by using the sensitizing screen 1 having a three layer structure shown in FIGS. 3 and 4.

In this embodiment as shown in FIG. 3*a*, the sensitizing screen 1 comprises a conductive screen mesh 2, a sensitizing layer 5 provided on one surface of the mesh 2 and a transparent insulating layer 3' provided on the sensitizing layer 5 resulting in a formation of three layer structure. The thus formed screen 1, is uniformly charged with for example, negative polarity by the corona generator 7 which is movably arranged at the side of the insulating layer 3'. Then, as shown in FIG. 3*b*, a movable corona generator 14 and a document 15 are arranged at the side of the transparent insulating layer 3' of the uniformly charged screen 1, and a light image of the document 15 is projected to the sensitizing screen 1. At the same time, the sensitizing screen 1 is corona charged with opposite polarity, a positive polarity, to that of charges shown in FIG. 3*a*, or AC charged with superimposition of positive DC voltage by the utilization of the corona generator 14. By this step, a primary latent image corresponding to the light image consisting of positive and negative charges is formed on the transparent insulating layer 3' of the sensitizing screen 1. Then, the thus charged screen 1 is uniformly exposed (not shown) so that a primary latent image having high electrostatic contrast is formed on the transparent insulating layer 3'.

As shown in FIG. 4, the transparent insulating layer 3' of the sensitizing screen 1 is arranged opposite to the charge storage layer 11 of the transferring member 9. A corona fine wire 13' of the corona generator is arranged at the position of the screen 1 opposite to the transferring member 9 and then a corona supply source 16 is connected between the fine wire 13'. The conductive screen mesh 2 of the screen 1 and a screen bias supply source 17 is connected between the mesh 2 and the conductive base plate 10 of the member 9 so as to create the voltage differences among the fine wire 13', the screen mesh 2 and the conductive base plate 10. The positive corona ions are projected to the transferring member 9 through the sensitizing screen 1 from the corona fine wire 13'. The corona ion flow is modulated by the primary latent image formed on the transparent insulating layer 3' of the screen 1 and the secondary latent image is formed on the transferring member 9 by the modulated corona ion.

The secondary latent image formed on the transferring member 9 is developed by toner and transferred to the record member. In this case, the storage characteristic of the secondary latent image formed on the transferring member 9 is excellent compared to the primary latent image of the sensitizing screen 1, so that a great number of copies are obtained by repeatedly developing and transferring the secondary latent image formed on the transferring member 9. The density of the primary latent image formed on the sensitizing screen 1 is decreased to a small extent by the corona ions which are at the sensitizing screen 1 but the major part of the primary latent image is stored over a relatively long time so that a number of secondary latent images can be formed on the transferring member 9 by repeatedly using the primary latent image.

In the electrophotographing method according to the present invention, the storage characteristic of the primary electrostatic latent image formed on the sensitizing screen 1 is utilized when a great number of copies are obtained from the secondary latent image formed on the transferring member 9, by repetition of developing and transferring. Then the secondary latent image is erased and the new secondary latent image is again formed on the transferring member 9 based on the primary latent image stored on the sensitizing screen 1 or the decreased amount of the secondary latent image formed on the transferring member 9 is supplemented by the primary latent image stored on the sensitizing screen 1. Then a great number of copies are obtained from the primary latent image once formed on the sensitizing screen 1.

Figure 5:
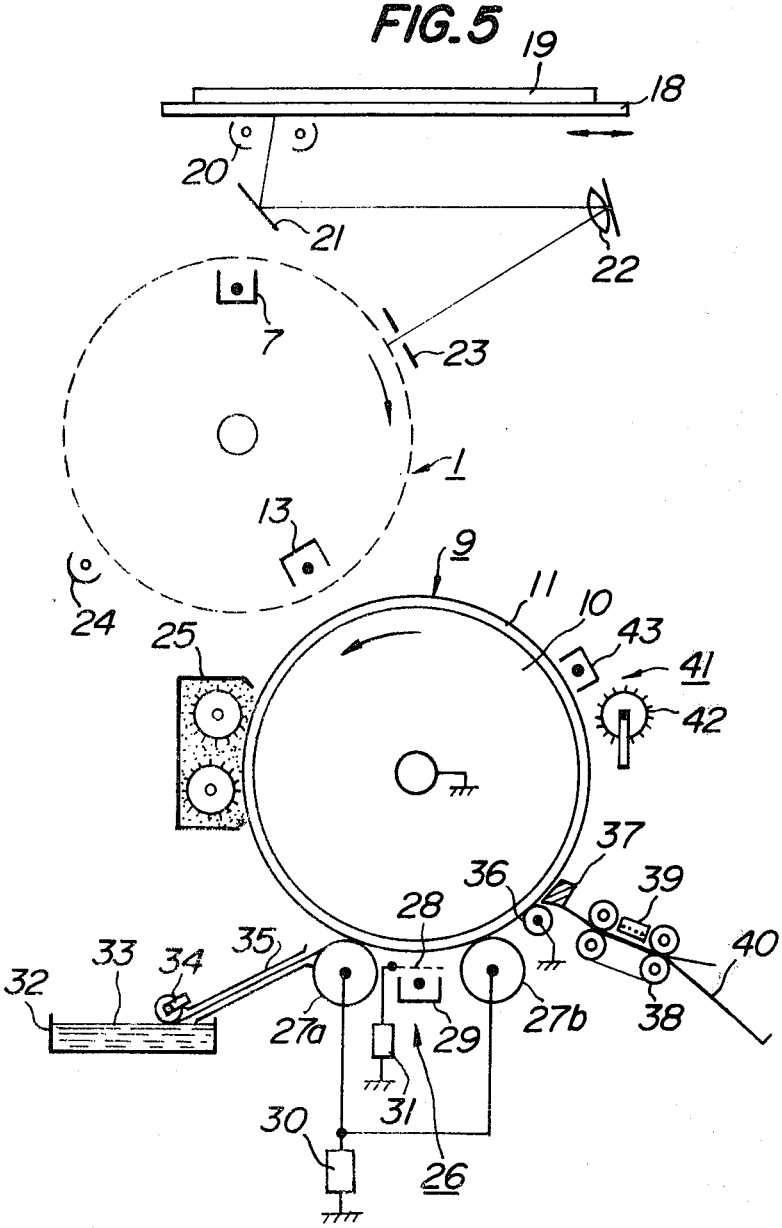
FIG. 5 is a diagrammatic view showing the construction of an electrography apparatus according to the present invention.

FIG. 5 is a diagrammatic view showing a construction of an electrophotographing apparatus according to the present invention. The same members are marked by the same references shown in FIGS. 1 to 4.

In this embodiment, the sensitizing screen of a four layer structure shown in FIGS. 1 and 2 is used as a sensitizing screen 1. The screen 1 is constructed in the form of a drum which is rotatable in the direction of an arrow, and a sensitizing layer 5 (refer to FIG. 1) is provided around the screen drum. A transferring member is also constructed in the form of a drum which is rotatable in the direction of an arrow and a charge storage layer 11 is provided around the drum member 9. The drum screen 1 is arranged opposite to the drum member 9 with a predetermined distance. A corona generator 7 for uniformly charging the sensitizing screen 1, as shown in FIG. 1*a*, is arranged at the inner side of the drum screen 1. As shown in FIG. 1*b* a light image is projected on the sensitizing screen 1 uniformly charged by the corona generator 7. To this end, a document 19 placed on a platform 18 which is movable in both directions is illuminated by an illuminating lamp 20 and a light image of the document is imaged on the sensitizing screen 1 through a reflecting mirror 21, an in-mirror lens 22 and a slit 23. Alternatively, the platform 18 may be fixed and the optical system may be movable. A corona generator 13 for projecting the corona ion flow (FIG. 2) is arranged at the inner side of the screen drum 1 to form a secondary latent image on the charge storage layer 11 of the transferring member 9. An illuminating lamp 24 is arranged for full exposure between the corona generator 13 and the corona generator 7 for uniform charging and over the periphery of the screen drum 1.

A developing means 25 for visualizing the secondary latent image by an electroscopic coloring toner and forming a toner image is arranged near the periphery of the transferring member 9 and before the position for forming the secondary latent image (as viewed toward the rotating direction of the member 9). A transferring section 26 for transferring the toner image on the transfer paper is arranged before the developing means 25. The transferring section 26 comprises a pair of transfer rollers 27*a* and 27*b* which consists of conductive material or a conductive member having an insulating treated surface, a corona generator 29 arranged at the position opposite to and near the transferring member 9 and a conductive screen 28 arranged between the member 9 and the corona generator 29. A supply source 30 for biasing the roller and a screen bias supply source 31 are connected between the pair of the transfer rollers 27*a*, 27*b* and the conductive screen 28 and the transferring member 9, respectively.

Recording members (transfer papers) 33 provided in a paper cassette 32 are picked up one by one by a feeding roller 34 and are carried by the pair of the transfer rollers 27*a* and 27*b* through a paper guide 35 and contacted to the periphery of the transferring member 9. In this case, the toner image formed on the member 9 is transferred to the transfer paper 33.

The transfer paper 33 which has been transferred by the toner image, is peeled off from the member 9 by a grounded roller 36 and a peeling projection 37 and a final copy is taken out on a tray 40 through a carrying belt 38 and a fixer 39.

A cleaning section 41 eliminates the residual charge and the residue toner which are left on the member 9 after transferring is arranged between the peeling projection 37 and the secondary latent image forming portion and near the periphery of the member 9. In this embodiment, the cleaning section 41 comprises a cleaning brush 42 and an eraser 43.

The operation of the electrophotographing apparatus shown in FIG. 5 is explained as follows.

The sensitizing screen 1 rotates in the direction of the arrow in synchronization with the movement of the platform 18. The screen 1 is uniformly charged with for example, positive polarity, by the corona generator 7 and the primary latent image is formed on the screen 1 at the light image illuminating position. The corona generator 13 charges on the charge storage layer 11 of the transferring member 9 with opposite polarity, i.e. negative polarity at the secondary latent image forming position to form the secondary latent image. In this case, if the transferring member 9 is rotated in synchronization with the screen 1, the secondary latent image having no distortion can be obtained. If the charge storage layer 11 for storing the secondary latent image is constructed by the above described materials, the charge decreasing characteristic of the storage layer 11 is excellent i.e., a few percent at ten minutes. When the charge storage layer is constructed of materials having a frictional charge series equal to or close to that of the developer, frictional charging in case of high speed developing by powder developer is prevented. When such materials are coated on the surface of the charge storage layer the effects of preventing the secondary latent image from increasing and charge causing overdevelopment from generating can be obtained during multiple transfer.

In order to obtain a great number of transferred images from the secondary latent image formed on the transferring member 9 the following must be taken into consideration.

(1) The charge storage characteristic of the transferring member 9 is excellent.

(2) In developing, a higher insulating developer must be used to lessen the decrease of the latent image.

(3) In the transferring means, if in the corona charge transferring and the roller bias voltage transferring the charge voltage and the bias voltage are made higher to increase the transferring efficiency, the charges are injected into the surface of the transferring member through the transfer paper, because generally the transfer paper (plain paper) has a resistance of $10^8$ to $10^{14}$ Ωcm. As a result, during multiple transfer, an overdeveloping phenomenon caused by the base of the document appears in the next copy. When 100% of toner image is transferred in the transferring step, the decrease of the latent image becomes fast, so that a decrease of the latent image must be lessened by the use of the insulating nature of toner through covering the latent image with the residue toner.

The secondary latent image formed on the transferring member 9 is developed in the developing means 25 by cascade development or magnetic brush development to obtain the toner image. In this case, the cascade development is preferably used to lessen the decreasing of latent image because the carrier is generally an insulator such as glass and the toner has a pigment covered by insulating resin. In case of magnetic brush development, the magnetic substance having conductive nature is generally used as a carrier and excellent storage of the latent image can be obtained by using a developer having a comparatively large toner (insulating) mixing ratio in the mixing ratio of carrier and toner. It is also advantageous to use a developer having magnetic carrier of which the surface is coated with insulating resin. In case of one component toner developer, for example, in case of toner particle being magnetic substance the excellent effect can be obtained by high insulating magnetic toner.

In the transferring section 26, the transfer paper 33 is superimposed onto the toner image so that the toner image is electrostatically attracted to and transferred to the paper 33. In this case, the electrostatic attraction and transferring of the toner image may be effected by a corona charge transferring method in which the transferring is effected by corona charge having opposite polarity to that of the toner from the back side of the transfer paper. A roller bias transferring method is also used in which the conductive or semiconductive roller or the conductive roller having a surface coated by insulating film is contacted to the back of the transfer paper and is applied by bias voltage having opposite polarity to that of toner. In both transferring methods, however, when the amount of corona charge and the roller bias voltage are made high to increase the transferring effect, the above described charge causing overdevelopment is generated on the surface of the transfer paper so that multiple transferring cannot be effected. In case of corona transferring by for example, corona charge voltage of 4 to 6 kv, a few number of copies cause substantial overdevelopment for the base (background) of the document. In case of transfer roller by the bias voltage of 1 kv (with utilization of roller having insulating film of 10μ) few tens of copies arise overdevelopment phenomenon. With the conductive roller and a bias voltage of 500 to 600 v, few copies result due to an overdevelopment phenomenon. When the corona charge voltage is decreased to lessen the overdevelopment phenomenon, the corona discharge becomes non-homogeneous and the transferring density becomes insufficient. The same events arise even if the transfer roller bias voltage is decreased.

According to the present invention the following steps are utilized to effect multiple transferring with high efficiency by low bias voltage.

(1) The voltage of the secondary latent image is few hundreds to 1,000 v, preferably few hundreds, to make adhesive power for adhering toner to the transferring member 9 relatively small.

(2) The roller bias voltage of for example 250 to 700 v is applied to a pair of the transfer rollers 27*a* and 27*b* by a roller bias supply source 30.

(3) To improve the excess transferring voltage and current, the ion flow of the corona generator 29 for supplementing the non-homogeneous effects being defect of roller transferring is controlled by corona transferring with screen bias control by for example, screen bias source 31 of 250 v to 500 v. It is found that in addition to such steps, the overdevelopment due to the injection of charge passing through the transfer paper 33 and the transferring efficiency are selected and the surface of the latent image is covered by the residue toner, so that a great number of copies can be obtained. The secondary latent image with a potential of about 300 v is formed on the transferring member 9 and the magnetic brush development is effected by two component developer (made by Dai Nippon Ink Chemical Co. No. 57) having relatively high percent, such as a few percent to ten several percent of toner content. If the content of toner is too high, the toner is mechanically adhered to the transferring member 9 and thus the overdevelopment (fog) phenomenon appears. The transfer paper 33 is then fed by the feed roller 34 in synchronism with the rotation of the transferring member 9 in the transferring section 26 and passed through the transfer rollers 27*a* and 27*b* and the corona generator 29. In this case, the voltage of −200 v to −400 v is applied to the transfer rollers 27*a* and 27*b* (made by a conductive rubber roller) or the voltage of −450 v to −650 v is applied to the transfer roller (made by a conductive rubber roller or a semiconductive rubber roller having an insulating treated surface). The voltage of −250 v to −450 v is applied to the conductive screen 28 and the voltage of −4 kv to −6 kv is applied to the corona generator 29. The transfer paper 33 is peeled off from the transferring member 9 by the peel project 37 through the grounded roller 36 for preventing discharge after the toner image is electrostatically transferred to the paper 33. The reason for using the grounded roller 36 is that if the transfer paper 33 having charges stored on the back surface of the paper and caused by the corona generator 29, is peeled from the transferring member 9, a discharge occurs between the transfer paper 33 and the transferring member 9. Noise due to the above discharge is generated on the charge storage layer 11 of the transferring member 9 and thus multiple transferring cannot be effected. If transferring is effected only by the roller bias transfer method, the discharge does not occur so that the grounded roller 36 may be omitted.

After peeling, the transfer paper 33 is fixed by a heat or pressure fixer 39 and picked out in the tray 40. By rotating the transferring member 9 the necessary times, development and transferring are repeated, so that the excellent copies, i.e. two hundred to three hundred, can be obtained.

Figure 6A:
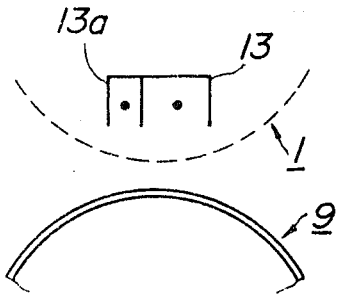
FIGS. 6*a*, 6*b* and 6*c* are diagrammatic views showing construction of different corona generators by which corona ion flow is projected to a transferring member to form a secondary latent image.
Figure 6B:
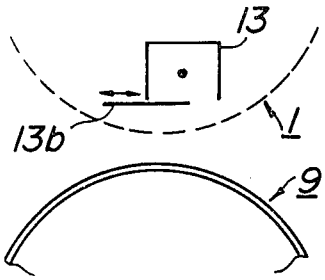
Figure 6C:
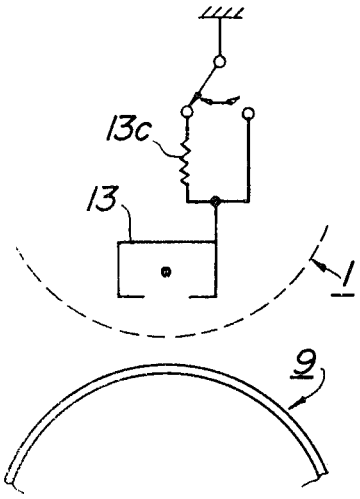

The sensitizing screen drum 1 may be stopped or always rotated during the repetition of developing and transferring. If the number of copies is very large, the cleaning section 41 cleans the residue charge and toner on the surface of the transferring member 9, after transferring for a predetermined number of times for one secondary latent image, a new secondary latent image is again formed on the transferring member 9 from the stored primary latent image. Alternatively, the transferring member 9 is synchronously rotated with the sensitizing screen drum 1, and a decreased amount of the secondary latent image may be supplemented from the primary latent image on the screen drum 1. In this case, the cleaning step of the residue charge can be omitted. A little amount of ion flow may also be applied to the transferring member 9 through the primary latent image from the corona generator 13, so as to continuously supplement the decreased charge of the latent image. In this case, as shown in FIG. 6*a*, the corona generator 13 is provided with a corona generator 13*a* for supplementing the reduced amount of the secondary latent image and having very small distribution width of corona charge, so that the corona generator 13 is charged to the corona generator 13*a* during continuous transferring. As shown in FIG. 6*b*, the corona flow from the generator 13 may also be controlled by a movable conductive shield member 13*b*. Alternatively, as shown in FIG. 6*c*, a small amount of ion flow is applied to a shield member 13*b*′ of the corona generator 13 connected to a resistance 13*c* and the shield member 13*b*′ may be grounded directly or through the resistance 13*c*. By the above steps, a great number of copies may be obtained from the primary latent image formed on the sensitizing screen 1. In the present embodiment, A4 size of copy is effected with a transferring speed of 60 time/min and about two thousand excellent copies can be obtained. If the stored time of the latent image formed on the screen 1 is effectively used by increasing of the transferring speed and shortening of transferring time or the primary latent image is stored on the transparent insulating layer 3′ as shown in FIGS. 3 and 4, about a few thousand copies may be obtained. The rotation number of the transferring member must be increased to increase the transferring speed, but the mechanical factor and the corona charge factor must be taken into consideration for the rotation speed in the step of forming the primary and the secondary latent images and the step of cleaning the transferring member 9. It therefore is preferable, that the screen drum 1 and transferring member 9 are rotated at slow speed during the steps of forming the primary and the secondary latent images and of cleaning the transferring member 9, then only is the transferring member 9 rotated at high speed during the developing and transferring step. The change of the rotating speed may be effected by a combination of an electromagnetic clutch and a gearing or the rotation change of a double speed motor.

According to the apparatus described above, a great number of copies can be obtained by one exposure of a document at very high speed. In the conventional type of developing and transferring on the sensitizing member, a number of copies cannot be obtained with high speed since the sensitizing member is apt to subject mechanical wears but in the present apparatus such wear of the sensitizing member cannot be subjected. Moreover, the apparatus cannot be affected by ozone or the like, because the corona charge is very small during formation of the secondary latent image. Therefore, the life span of the sensitizing member can be almost permanently increased. The transferring member has durability especially when made of material such as: glass or allyl diglycol carbonate resin. Even if other resins mentioned before are used, as the transferring member, the member is excellent. In the manufacturing method for the transferring drum member, the drum is dipped in a vessel having melted resin therein and pulled up with a certain speed to thereby obtain a certain accuracy. Moreover, such accuracy may be obtained by providing an insulating member of a film such as Mylar on the metal drum and by exchanging the Mylar periodically.

To improve the storage nature of latent image the moisture around the sensitizing screen and the transferring member is decreased. To this end, the atmosphere around the screen and the member is made higher than the room temperature by 5° C. to 15° C., by using for example, a fixing heater to circulate the warm wind or by accommodating the heater in the transferring member or blowing the heated window to the transferring member to warm the atmosphere, so that the storage nature for the latent image may preferably be maintained. When the transfer paper is subjected to insulating treatment, the charges are injected into the transfer paper from the corona generator or the transfer roller, so that the decay of charges of latent image on the transferring member can be prevented. If the plain paper is subjected to insulating treatment, the surface resistance or the volume resistance thereof, can be improved by more than two orders so that such coated paper can advantageously be applied to the present invention. If the transfer paper is subjected to a treatment in which the resistance value of the transfer paper does not change by heating, the heat transfer can be effected and thus the fixing step can simultaneously be effected with the transferring.

The electrophotography apparatus according to the present invention utilizes a drum shaped sensitizing screen 1 and a drum shaped transferring member 9, but the sensitizing screen 1 may be constructed in a plane form and the transferring member may be constructed in an endless belt form.

Moreover, the apparatus utilizes a pair of the transfer rollers 27*a* and 27*b* arranged in the transferring section but any number of the transfer rollers may be used and the roller bias voltage may be applied to any number of rollers. If a plurality of transfer rollers are provided, the roller bias voltages have different values for the rollers respectively.

What is claimed is:

1. An improved method of electrophotographing, employing an apparatus having a sensitizing screen with a great number of fine apertures and a transferring member including a conductive base plate and at least one charge storage layer formed on said base plate and made of material selected from a group consisting of highly insulating glass, polyurethane, acrylic resin, epoxy resin, polyethylene, polystyrene, vinyl chloride resin, nylon, polyimide resin, silicone resin, fluorine plastics, allyl diglycol carbonate resin and mixtures thereof, comprising (a) a step of forming on said sensitizing screen a primary electrostatic latent image corresponding to an image of a document to be copied;

(b) a step of forming on said transferring member a secondary electrostatic latent image corresponding to said primary latent image by projecting through said sensitizing screen a corona ion flow modulated by said primary latent image onto said transferring member;

(c) a step of developing said secondary latent image with toners to form a toned image;

(d) a step of transferring said toned image onto a recording sheet to form a duplicated copy;

(e) a step of repeatedly conducting said steps (c) and (d) in succession by a number M of times to form a number M of duplicated copies, said number M being the maximum number of copies which can be formed from one and the same secondary latent image;

(f) a step of erasing said secondary latent image; and (g) a step of repeatedly conducting said steps (b) to (f) in succession by a number N of times to form a total of M×N number of duplicated copies from one and the same primary latent image once formed on said sensitizing screen.

2. An improved method of electrophotographing, employing an apparatus having a sensitizing screen with a great number of fine apertures and a transferring member including a conductive base plate and at least one charge storage layer formed on said base plate and made of material selected from a group consisting of highly insulating glass, polyurethane, acrylic resin, epoxy resin, polyethylene, polystyrene, vinyl chloride resin, nylon, polyimide resin, silicone resin, fluorine plastics, allyl diglycol carbonate resin and mixtures thereof, comprising (a) a step of forming on said sensitizing screen a primary electrostatic latent image corresponding to an image of a document to be copied;

(b) a step of forming on said transferring member a secondary electrostatic latent image corresponding to said primary electrostatic latent image by projecting through said sensitizing screen a corona ion flow modulated by said primary latent image to said transferring member;

(c) a step of developing said secondary latent image with toners to form a toned image;

(d) a step of transferring said toned image onto a recording sheet to form a duplicated copy;

(e) a step of repeatedly conducting said steps (c) and (d) in succession to form a plurality of copies; and (f) a step of supplementing said secondary latent image by projecting through said sensitizing screen a controlled corona ion flow modulated by said primary latent image onto said transferring member during the process of said step (e) to compensate a deterioration of the secondary latent image on said transferring member.

3. An improved electrophotographic apparatus comprising a sensitizing screen, said screen being disposed on a drum and having a great number of fine apertures;

means for forming and storing on said screen a primary electrostatic latent image corresponding to an image of a document to be copied;

means for erasing the primary latent image;

a transferring member arranged opposite to the sensitizing screen and including a conductive drum and at least one charge storage layer formed on said conductive drum and made of material selected from a group consisting of highly insulating glass, polyurethane, acrylic resin, epoxy resin, polyethylene, polystyrene, vinyl chloride resin, nylon, polyimide resin, silicone resin, fluorine plastics, allyl diglycol carbonate resin and mixtures thereof;

a corona generator for projecting through said sensitizing screen a corona ion flow onto said transferring member to form a secondary electrostatic latent image on said transferring member corresponding to said stored primary latent image;

means for developing said secondary latent image with toners to form a tone image;

means for transferring said toned image onto a recording sheet to form a duplicated copy;

means for repeatedly operating said developing and transferring means in succession to form a plurality M of copies, said number M being the maximum number of copies which can be formed from one and the same secondary latent image;

means for erasing said secondary latent image after said plurality M of copies have been formed; and means for operating repeatedly said corona generator to form a number N of secondary electrostatic latent images on said transferring member corresponding to said primary latent image each time said erasing means has been operated, whereby a total of M×N number of duplicated copies are formed from one and the same primary latent image once formed on said sensitizing screen.

4. An improved electrophotographic apparatus comprising a sensitizing screen, said screen being disposed on a drum and having a great number of fine apertures;

means for forming and storing on said screen a primary electrostatic latent image corresponding to an image of a document to be copied;

means for erasing the primary latent image;

a transferring member arranged opposite to the sensitizing screen and including a conductive drum and at least one charge storage layer formed on said conductive drum and made of material selected from a group consisting of highly insulating glass, polyurethane, acrylic resin, epoxy resin, polyethylene, polystyrene, vinyl chloride resin, nylon, polyimide resin, silicone resin, fluorine plastics, allyl diglycol carbonate resin and mixtures thereof;

a corona generator for projecting through said sensitizing screen a corona ion flow onto said transferring member to form a secondary electrostatic latent image on said transferring member corresponding to said stored primary latent image;

means for developing said secondary latent image with toners to form a toned image;

means for transferring said toned image onto a recording sheet to form a duplicated copy; and means for projecting through said sensitizing screen a supplementing corona ion flow modulated by said primary latent image onto said transferring member to supplement the secondary latent image, while said sensitizing screen and transferring member are driven in synchronism with each other.

5. An apparatus according to claim 4, wherein said supplementing corona ion flow projecting means comprises a second corona generator arranged beside said corona generator.

6. An apparatus according to claim 4, wherein said supplementing corona ion flow projecting means is commonly formed by said corona generator and further comprises a shielding plate arranged movably at an opening of the corona generator.

7. An apparatus according to claim 4, wherein said supplementing corona ion flow projecting means is commonly formed by said corona generator and further comprises a series circuit of a resistor and a switch for selectively connecting a shield member of the corona generator to the earth directly and through said resistor.

* * * * *